US005255016A

United States Patent [19]

Usui et al.

[11] Patent Number: 5,255,016

[45] Date of Patent: Oct. 19, 1993

[54] INK JET PRINTER RECORDING HEAD

[75] Inventors: Minoru Usui; Satoru Hosono, both of Nagano, Japan

[73] Assignee: Seiko Epson Corporation, Tokyo, Japan

[21] Appl. No.: 572,529

[22] Filed: Aug. 27, 1990

[30] Foreign Application Priority Data

| | | | |
|---|---|---|---|
| Sep. 5, 1989 | [JP] | Japan | 1-229771 |
| Sep. 11, 1989 | [JP] | Japan | 1-234893 |
| Sep. 11, 1989 | [JP] | Japan | 1-234894 |
| Sep. 18, 1989 | [JP] | Japan | 1-241154 |

[51] Int. Cl.[5] ..... B41J 2/045

[52] U.S. Cl. ..... 346/140 R

[58] Field of Search ..... 346/140 PD, 140 R; 310/365, 359, 366, 330, 311

[56] References Cited

U.S. PATENT DOCUMENTS

| | | | |
|---|---|---|---|
| 4,072,959 | 2/1978 | Elmqvist | 346/140 R |
| 4,381,469 | 4/1983 | Ogawa et al. | 310/346 |
| 4,383,264 | 5/1983 | Lewis | 346/140 R |
| 4,469,976 | 9/1984 | Scott | 310/366 X |
| 4,516,140 | 5/1985 | Durkee et al. | 346/140 R |
| 4,584,590 | 4/1986 | Fischbeck et al. | 346/140 R |
| 4,638,206 | 1/1987 | Tsunooka et al. | 310/365 |
| 4,825,227 | 4/1989 | Fischbeck et al. | 346/1.1 |
| 4,888,598 | 12/1989 | Heinzl et al. | 346/140 R |
| 4,962,391 | 10/1990 | Kitahara et al. | 346/140 R |
| 5,063,396 | 11/1991 | Shiokawa et al. | 346/140 R |

FOREIGN PATENT DOCUMENTS

| | | | |
|---|---|---|---|
| 277703 | 10/1988 | European Pat. Off. . | |
| 0083274 | 6/1980 | Japan | 310/359 |
| 0072172 | 4/1988 | Japan | 310/330 |
| 0261071 | 10/1990 | Japan | 310/365 |

OTHER PUBLICATIONS

IBM Technical Disclosure Bulletin, vol. 22, No. 6, Nov. 1979, New York U.S. pp. 2527-2529; K. K. Shih & H. C. Wang: "Application of GMO as an active element to printing mechanism".

*Primary Examiner*—Benjamin R. Fuller
*Assistant Examiner*—Alrick Bobb
*Attorney, Agent, or Firm*—Sughrue, Mion, Zinn, Macpeak & Seas

[57] ABSTRACT

An ink jet printer recording head in which a plurality of vibrating plates made of a piezoelectric material are fixedly spaced from a nozzle plate such that the small gap therebetween admits a portion of ink. The surface of each vibrating plate is integrally provided with a pair of positive and negative comb-type electrodes. By applying a voltage across these comb-type electrodes, the vibrating plates are bent toward the nozzles to pressure the ink and attendantly eject the ink through the nozzles in the form of ink droplets on a recording sheet.

16 Claims, 11 Drawing Sheets

INK JET PRINTER RECORDING HEAD

BACKGROUND OF THE INVENTION

1. Field of the Invention

This invention relates to an ink jet printer recording head which records an image on a recording medium by ejecting ink droplets.

2. Prior Art

Disclosed in Japanese Patent Examined Publication No. 8957/1985 is an on-demand type ink jet printer, in which piezoelectric conversion members are formed behind and slightly spaced apart from a substrate having nozzles thereby leaving a small gap between each piezoelectric conversion member and the substrate. A voltage is applied to the piezoelectric conversion members to cause them to be displaced thereby pressuring ink present between the piezoelectric conversion members and the substrate to attendantly eject the pressured ink through the nozzles in the form of ink droplets.

Compared to a general ink jet printer in which the ink is ejected by changing the volume of the ink chamber using the piezoelectric conversion members and by guiding the ink within the ink chamber to nozzles, the ink jet printer described above has each piezoelectric conversion member positioned adjacent to each nozzle and is displaced in the axial direction of the nozzle, so that it not only shortens the flow path of the ink and enhances the ink ejection efficiency and stability but is advantageous in that the piezoelectric conversion member can be operated without such disturbances as infiltration of air bubbles or dust in the ink.

In such an ink jet printer it is the gap between each piezoelectric conversion member and the substrate that plays an important role in determining the ejection speed and amount of discharged ink droplets, or the ejection response. In general, each piezoelectric conversion member, with its construction involving a laminate formed of a piezoelectric element and a metal plate, is subject to warp due to differences in thermal expansion coefficients of these two materials, thereby making it impossible to maintain a constant distance between the piezoelectric conversion member and the substrate. As a result, there exists not only the problem that the level of density fluctuates depending on the temperature, but also the extreme difficulty of making the piezoelectric conversion member thin thus losing the advantage of reducing the required drive voltage.

SUMMARY OF THE INVENTION

An object of the present invention is, therefore, to provide an ink jet printer recording head that allows a thinner piezoelectric conversion member to be formed that can be driven at a lower voltage, and wherein a constant gap can be maintained between each piezoelectric conversion member and the substrate.

To achieve the above object, the present invention provides an ink jet printer recording head, in which a pair of positively and negatively polarized comb-type electrodes are formed on the surface of an ink pressuring member equals vibrating plates made of a piezoelectric material to thereby allow each ink pressuring member to be directly deformed by applying a voltage across both comb-type electrodes.

Another object of the present invention is to deform each ink pressuring member more efficiently. To this end, both the upper surface and the lower surface of the ink pressuring member are provided with a pair of positive and negative comb-type electrodes. Alternatively, the comb-type electrodes can be formed in either the upper surface only or the lower surface only, so long as care is taken regarding the orientation of the comb-type electrodes in the vicinity of the pressuring member facing the nozzle, as well as the differently oriented comb-type electrodes in other regions of the ink pressuring member.

Still another object of the present invention is to construct the ink jet printer recording head more simply. To this end, in the present invention, the surface of each ink pressuring member formed of a piezoelectric material is not only provided with a pair of positively and negatively polarized comb-type electrodes, but is also provided with an ink ejecting nozzle to cause ink droplets to be ejected directly from the deformed ink pressuring member, thus obviating the need for a nozzle plate.

DETAILED DESCRIPTION OF THE PREFERRED EMBODIMENTS

Figure 1:
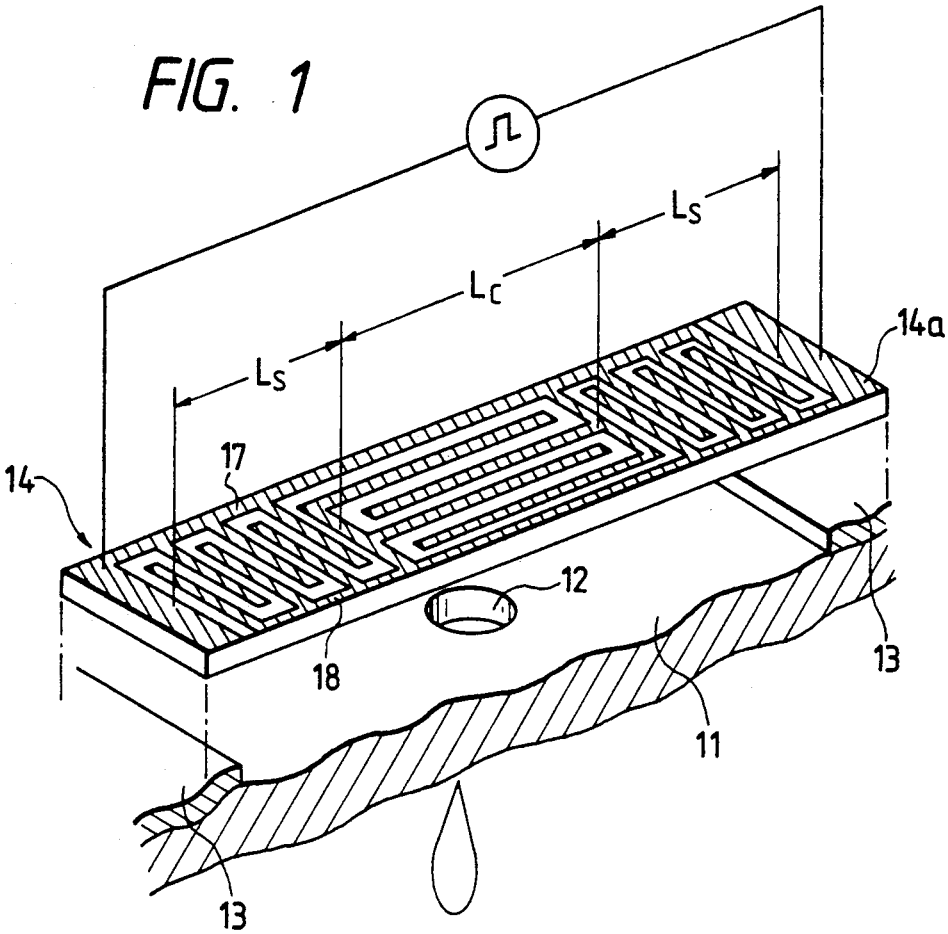
FIG. 1 is a partially exploded view showing a recording head according to a first embodiment of the present invention.

FIG. 1 is a partially enlarged view showing a typical recording head according to a first embodiment of the present invention.

Figure 2:
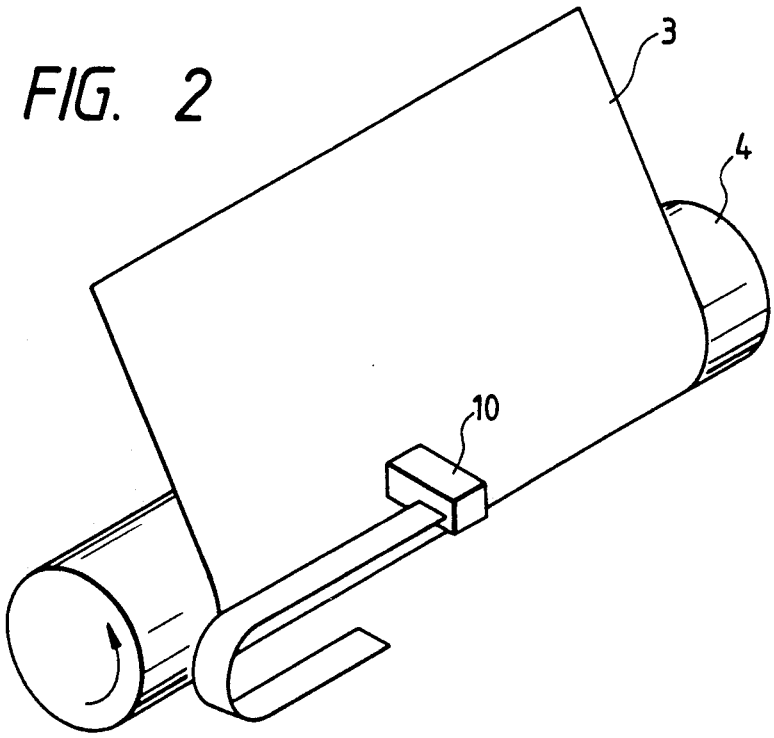
FIG. 2 is a view showing an ink jet printer having the recording head of the present invention.

This recording head is to be applied to an ink jet printer shown in FIG. 2. The ink jet printer recording head 10 is constructed so that it travels in the axial direction of a platen 4 and records a desired image on the surface of a recording sheet 3 that is forwarded by rotation of the platen 4 in the direction indicated by the arrow.

This recording head 10 comprises a nozzle plate 11 and vibrating plates 14 made of a piezoelectric material. The nozzle plate 11 is provided with a plurality of nozzles 12 arrayed from the upper left to the lower right in FIG. 1. On the nozzle plate 11 are 10–20 μm thick gap plates 13 that are bonded so as to interpose the nozzle 12 therebetween. These gap plates 13 may be unitized with the nozzle plate 11.

Each vibrating plate 14 serves as an ink pressuring member that pressures that ink introduced into a gap formed between the nozzle plate 11 and the vibrating plate itself, and ejects the pressured ink on a recording sheet from its nozzle 12. The vibrating plate 14 is stretched over the gap plates 13 such that a predetermined gap is formed with the nozzle plate 11. Each vibrating plate 14 is constructed having a thickness of 100 μm, and a width of only 0.34 mm. The narrower width of each vibrating plate 11 corresponds to the pitch between the nozzles 12 so as to allow each nozzle 12 to eject ink independently of the others. Each vibrating plate is bonded on the gap plates 13. It may be arranged by bonding a large width vibrating plate on the gap plates 13 and by cutting this vibrating plate with a dicing saw or photoetching it separately into a plurality of narrow width vibrating plates 14 corresponding to their respective nozzles.

Each vibrating plate 14 has electrodes integrally patterned on an upper surface 14*a* opposite to the nozzle plate 11 so that a positive comb-type electrode 17 and a negative comb-type electrode 18 can be meshed with each other. These electrodes 17, 18 are connected to a power supply.

The comb-type electrodes 17, 18 serve to deform the vibrating plate 14 by a voltage applied therebetween and it is desirable to set the pitch between their teeth to about half the thickness of the vibrating plate 14. The comb-type electrodes 17, 18 are formed so that their teeth extend in a longitudinal direction along the vibrating plate 14 at the middle region Lc right above the nozzle 12, but extend in a horizontal direction across the vibrating plate 14 at both end regions Ls.

Figure 3A:
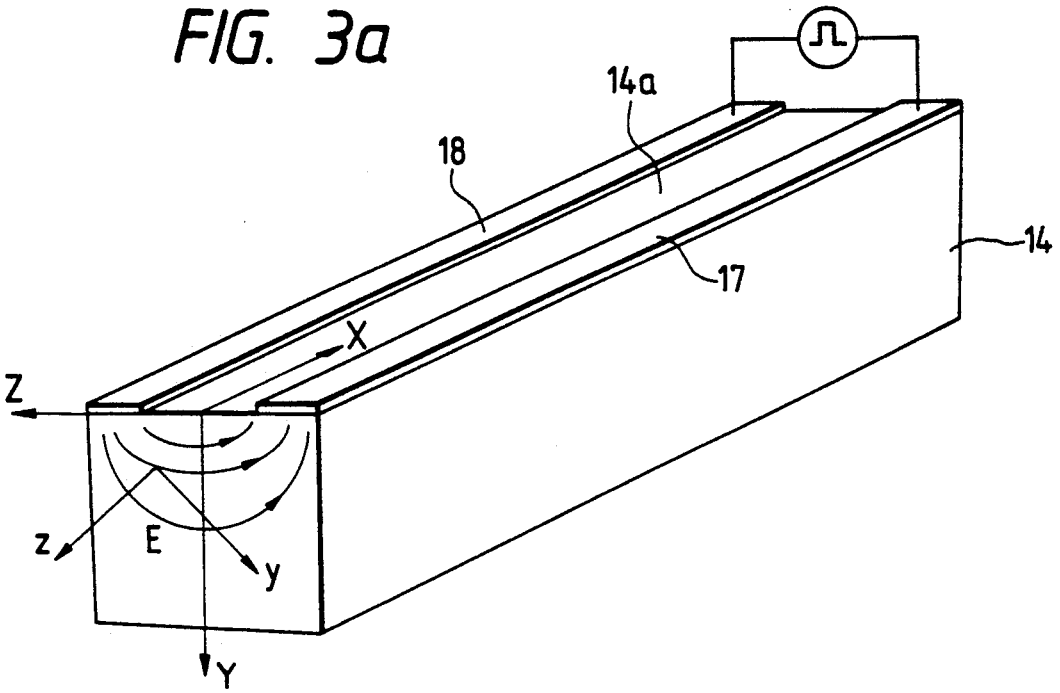
FIGS. 3*a* and 3*b* are views respectively showing the states before and after deformation at the middle region of the vibrating plate of FIG. 1.
Figure 3B:
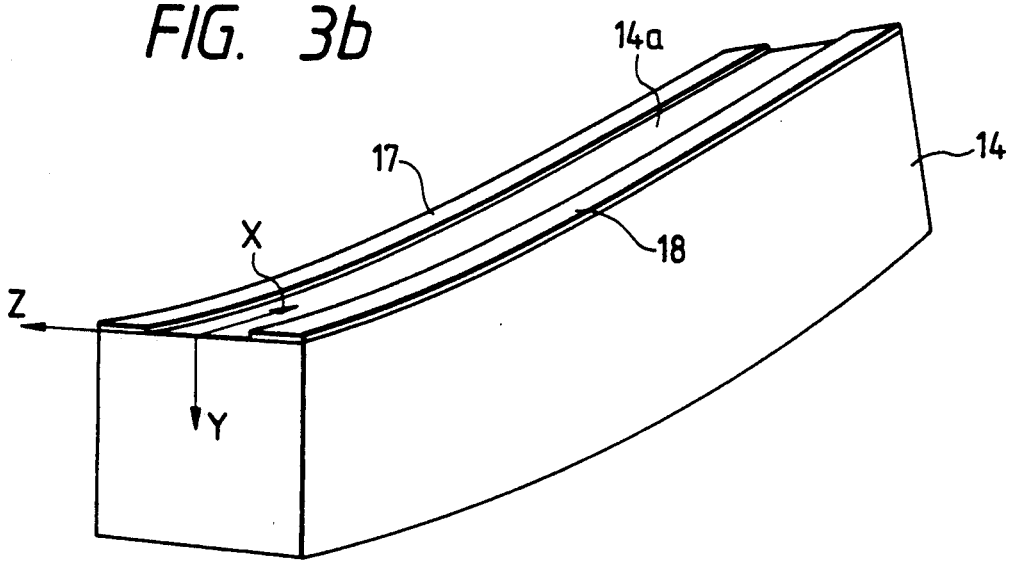

Upon application of a unidirectionally pulsed voltage between the comb-type electrodes 17, 18, an electric field as shown in FIG. 3*a* is produced in directions of arrow E between both electrodes 17, 18 at the middle region Lc, and strains are produced both in the direction of arrow y which is parallel to the electric field and in the directions of arrows x and z which are perpendicular thereto, respectively. With respect to the strains produced in the directions along (x direction) and across (z direction) the vibrating plate 14, the electric field intensity is larger on the upper surface 14*a* where the electrode pattern is formed. This causes the upper surface 14*a* to contract both lengthwise and widthwise at the middle region Lc of the vibrating plate 14, thereby producing larger strains lengthwise. As a result, the vibrating plate is bent in such a way that the upper surface, i.e., the surface 14*a* opposite to the nozzle plate 11, concaves as shown in FIG. 3*b*.

Figure 4A:
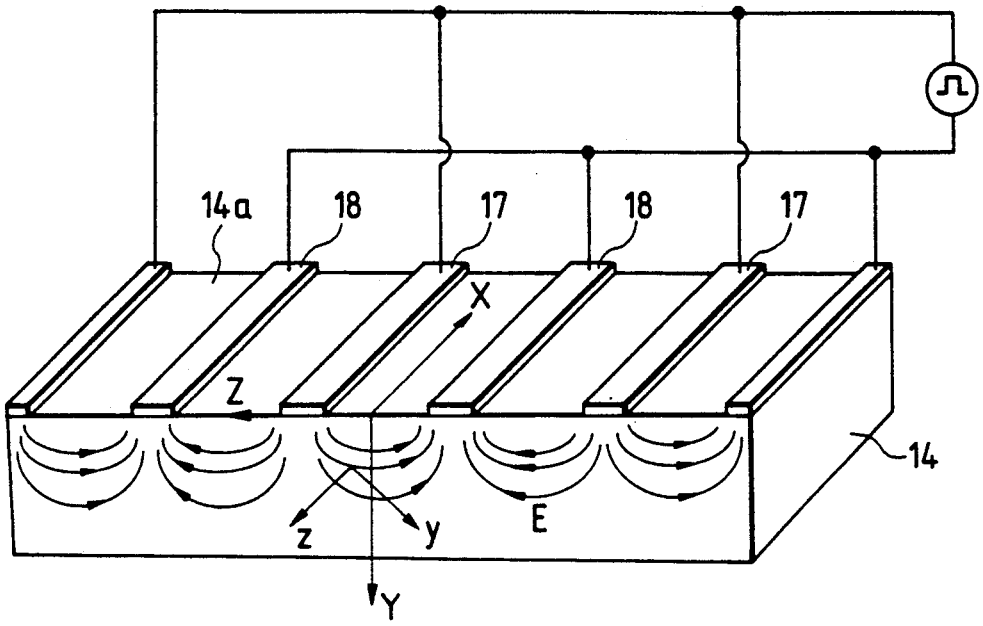
FIGS. 4*a* and 4*b* are views respectively showing the states before and after deformation at both ends of the vibrating plate FIG. 1.
Figure 4B:
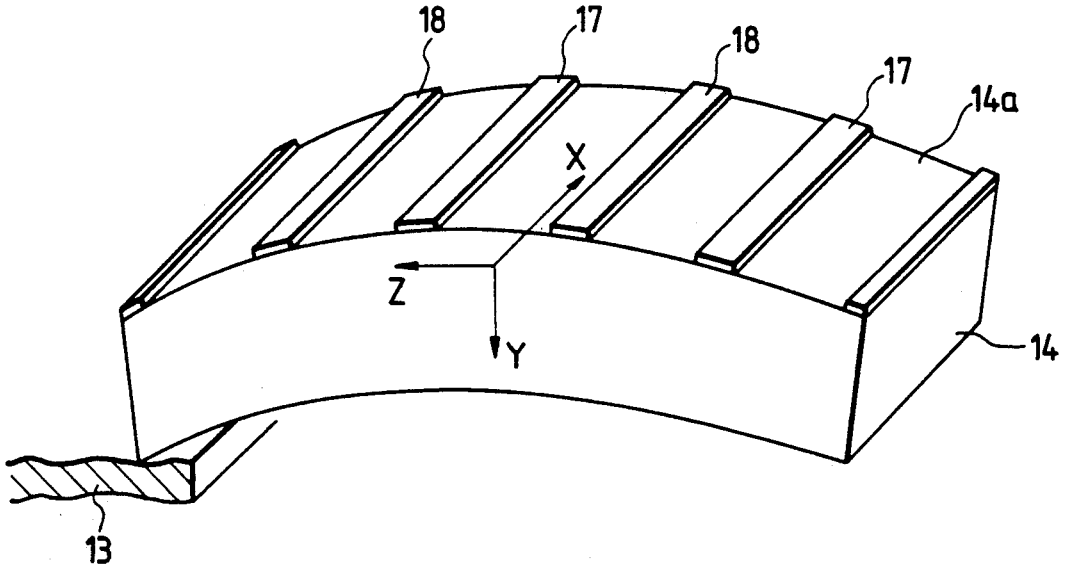
Figure 5A:
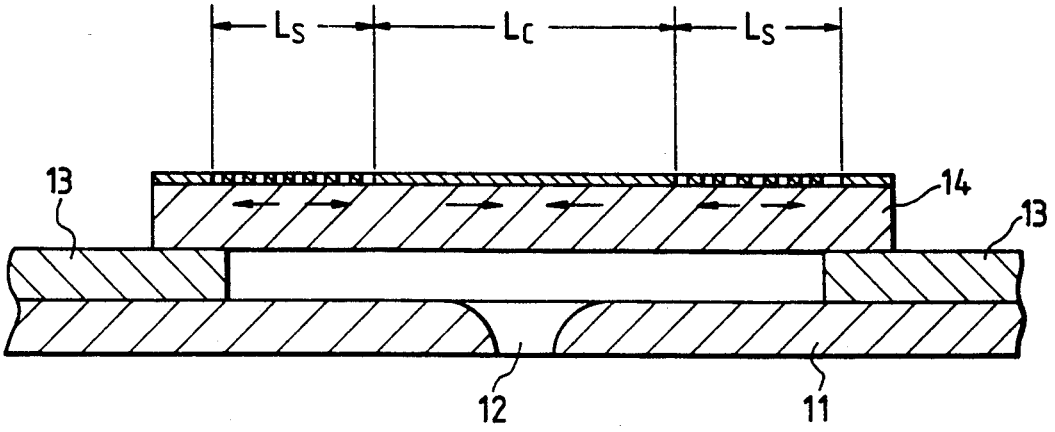
FIGS. 5*a* and 5*b* are views respectively showing the operation of ejecting ink by the vibrating plate of FIG. 1.
Figure 5B:
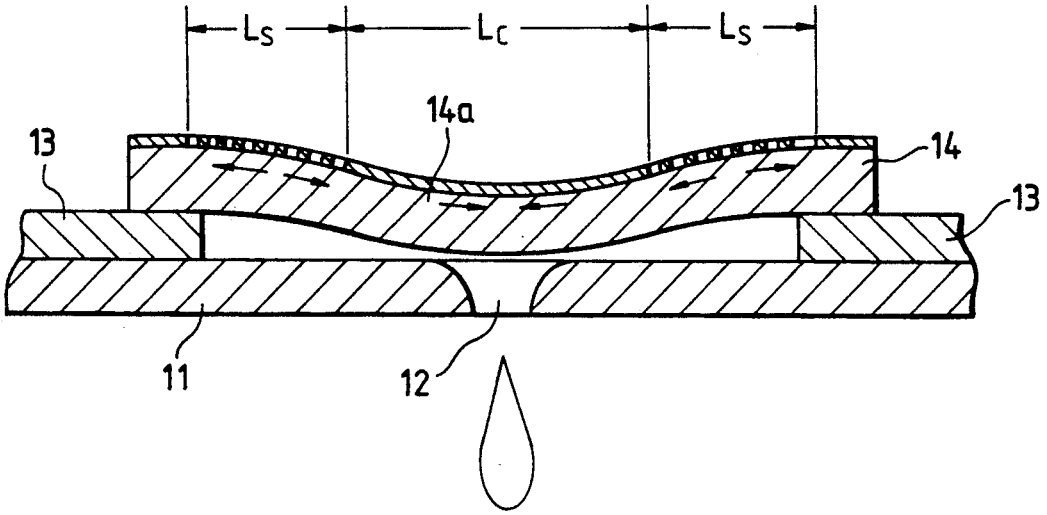

On the other hand, at the end regions Ls, when an electric field is produced in the direction of arrow E between both electrodes 17, 18 as shown in FIG. 4*a*, strains are likewise produced both in the direction of arrow y which is parallel to the electric field and in the directions of arrows x and z which are perpendicular thereto, respectively. And with respect to the strains produced in the direction of arrow y, the electric field intensity is larger on the surface 14*a* where the electrodes 17, 18 are formed, and this causes the surface 14*a* to be elongated both lengthwise and widthwise, thereby producing larger strains lengthwise thereon. As a result, the vibrating plate 14 is bent downward with each gap plate 13 as a fulcrum; i.e., the surface 14*a* opposite to the nozzle plate 11 convexes as shown in FIG. 4*b*.

Thus, each vibrating plate 14 is deformed in such a way that the surface 14*a* concaves at the middle region Lc and convexes at the end regions Ls, respectively. As a result, the vibrating plate 14 pressures the ink present between the nozzle plate 11 and itself and ejects the pressured ink in the form of ink droplets on a recording sheet (not shown) from its nozzle 12.

The maximum vibrating frequency of each vibrating plate 14 is determined by the Young's modulus of a piezoelectric material and the dimensions of the vibrating plate itself. According to an experiment, it was possible to eject the ink at a frequency of about 6 KHz. Although the comb-type electrodes 17, 18 in this embodiment are formed so as to be oriented differently at the middle region Lc and at the end regions Ls of each vibrating plate 14, they may be formed only at the middle region Lc to cause the vibrating plate 14 to be bent in a desired direction.

Figure 8A:
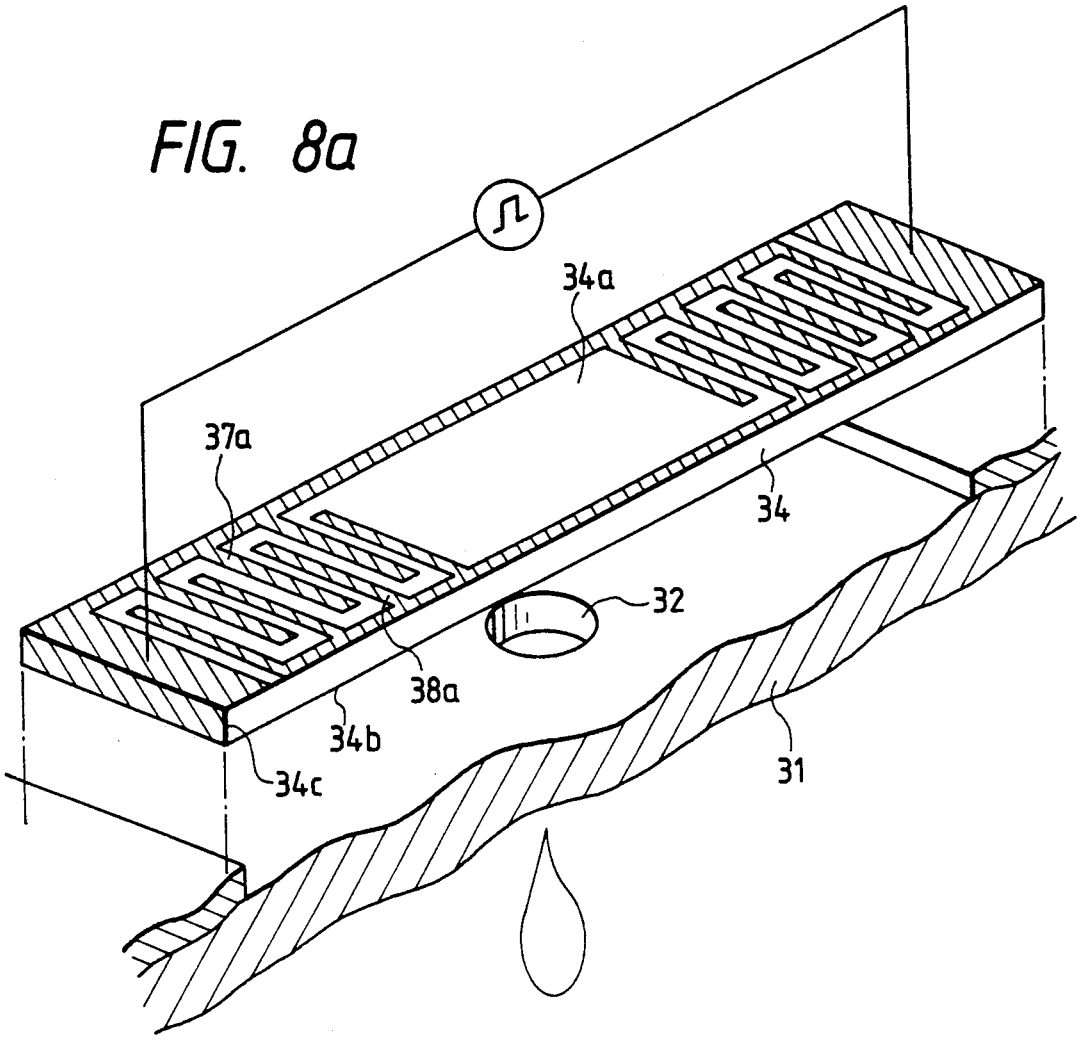
FIG. 8*a* is a view showing the main portion of a recording head according to a third embodiment of the present invention.

FIGS. 6, 8, and 9 show embodiments of the present invention in which the comb-type electrodes are formed on both surface of each vibrating plate so that the vibrating plate can be bent more efficiently.

In a second embodiment shown in FIG. 6, each of vibrating plates 24 is fixed while stretched over gap plates 23 that are arranged on both sides of a nozzle plate 21 in a manner similar to that in the first embodiment shown in FIG. 1.

Figure 6A:
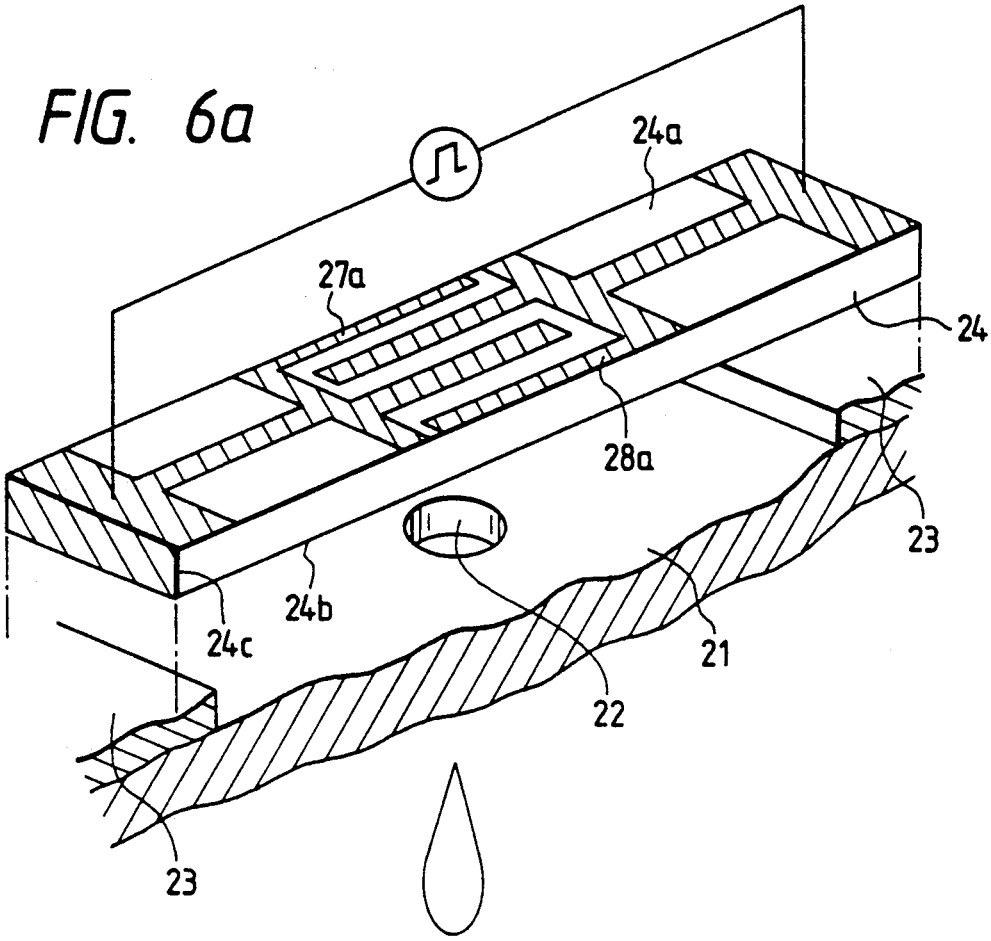
FIG. 6*a* is a view showing the main portion of a recording head according to a second embodiment of the present invention.
Figure 6B:
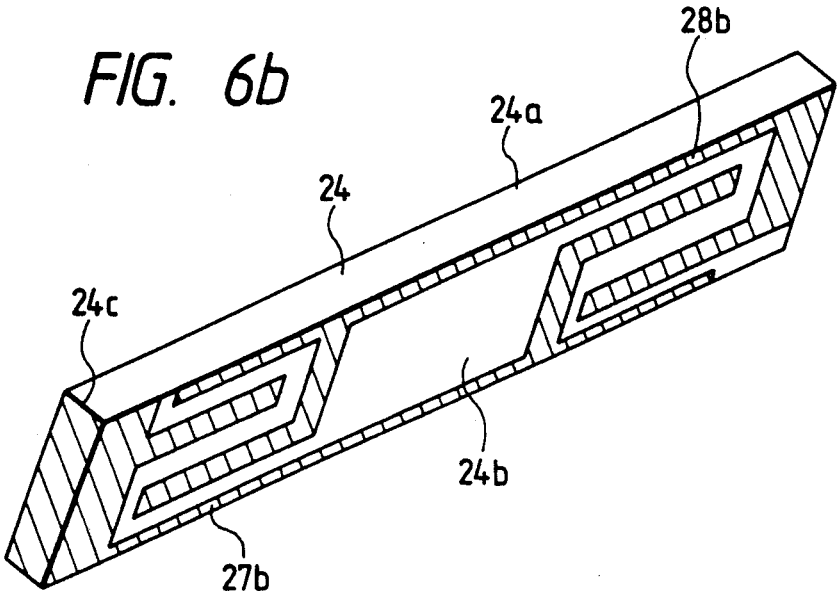
FIG. 6*b* is a view showing the back of a vibrating plate thereof.

On an upper surface 24*a* opposite to the nozzle plate 21 of the vibrating plate 24, as shown in FIG. 6*a*, a pair of comb-type electrodes 27*a*, 28*a* are formed so as to be meshed with each other along the vibrating plate 24 at the middle region which is right above a nozzle 22. On the lower surface 24*b* facing the nozzle plate 21, as shown in FIG. 6*b*, are a pair of comb-type electrodes 27*b*, 28*b* connected to the electrodes, 27*a*, 28*a* arranged on the upper surface through an end surface 24*c*. In contrast to the electrode pattern formed on the upper surface 24*a*, these comb-type electrodes 27*b*, 28*b* are patterned so that they are meshed with each other in the longitudinal direction at both ends of the vibrating plate 24.

Upon application of a voltage across both electrodes 27, 28 formed on the upper and lower surfaces 24*a* and 24*b*, the comb-type electrodes 27*a*, 28*a* at the middle region cause that region to contract, while on the lower surface 24*b*, the comb-type electrodes 27*b*, 28*b* disposed at both ends cause these ends to contract, as previously described with reference to FIG. 3. As a result, each vibrating plate 24 is bent with the middle region toward the nozzle 22 as shown in FIG. 7 thereby pressuring the ink in that region and ejecting it in the form of ink droplets through the nozzle 22.

Figure 8B:
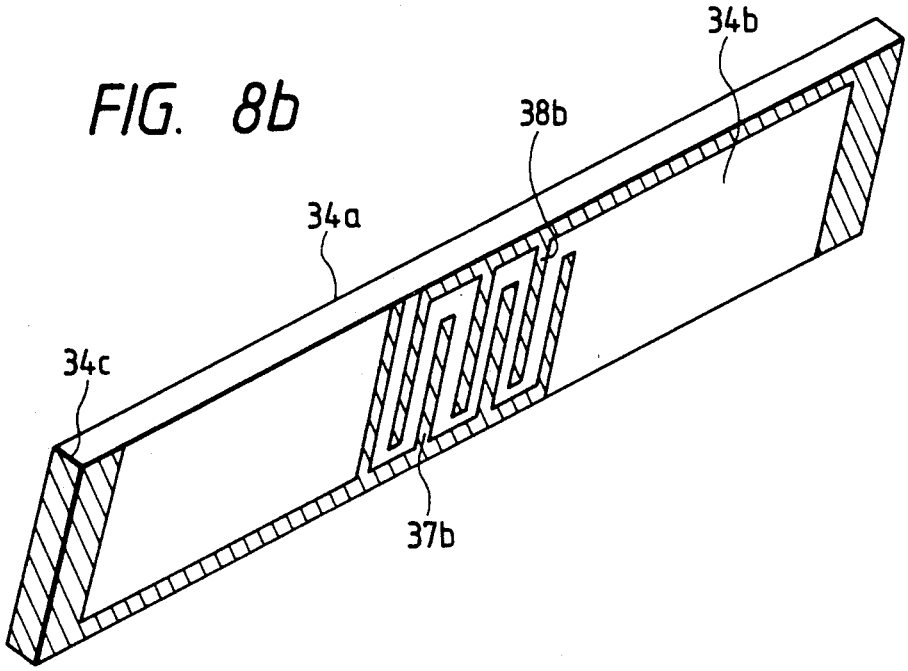
FIG. 8*b* is a view showing the back of a vibrating plate thereof.

A third embodiment shown in FIG. 8 has positively and negatively polarized comb-type electrodes 37, 38 formed on both upper and lower surfaces so as to face each other across a vibrating plate 34. That is, on an upper surface 34*a* opposite to a nozzle plate 31 of the vibrating plate 34 are both comb-type electrodes 37*a*, 38*a* formed at both ends, whereas on the lower surface 34*b* facing the nozzle plate 31 are both comb-type electrodes 37*b*, 38*b* patterned at the middle region, as shown in FIG. 8*b*. These electrodes 37*b*, 38*b* are connected to the electrodes 37*a*, 38*a* through an end surface 34*c* of the vibrating plate 34.

Figure 7:
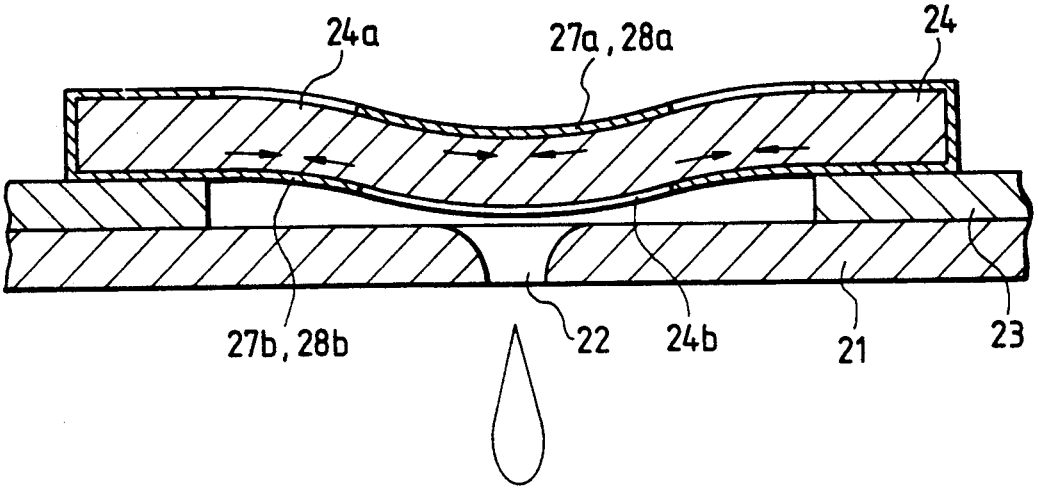
FIG. 7 is a view showing the operation of ejecting the ink by the vibrating plate of FIG. 6*a;*

Also in this embodiment, similar to FIG. 7, on the upper surface 34*a* of the vibrating plate 34, the comb-type electrodes 37*a*, 38*a* at both end regions cause such regions of the upper surface 34*a* to be elongated while the electrodes 37*b*, 38*b* at the middle region cause such region of the lower surface 34*b* to be elongated. As a result, the vibrating plate 34 is bent toward the nozzle 32.

FIG. 9 shows a fourth embodiment in which each of vibrating plates is formed as a cantilever and has comb-type electrodes arranged on both surfaces thereof.

On a gap plate 43 fixed on one surface of a nozzle plate 41 is the base end of each vibrating plate 44 that extends so that its free end covers a nozzle 42. On the vibrating plate 44 are a pair of positive and negative comb-type electrodes 47*a*, 48*a* on an upper surface 44*a* opposite to the nozzle plate 41 so that these electrodes face each other across the vibrating plate. Further, on the lower surface 44*b* facing the nozzle plate are comb-type electrodes 47*b*, 48*b* formed so that their teeth are meshed with each other along the vibrating plate 44 as shown in FIG. 9*b*. These electrodes 47*b*, 48*b* are connected to the electrodes 47*a*, 48*a* through an end surface 44*c* of vibrating plate 44.

Figure 10:
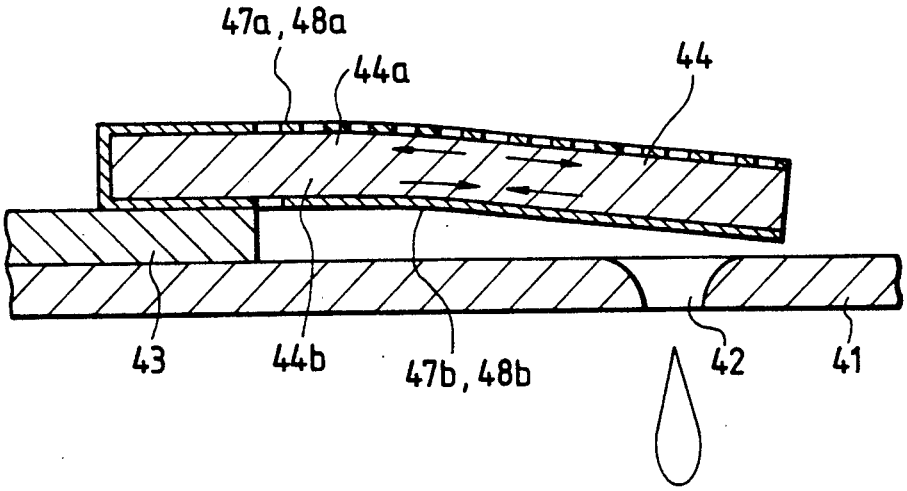
FIG. 10 is a view showing the operation of ejecting the ink by the cantilever-type vibrating plate of FIGS. 9*a* and 9*b;*

In this embodiment, upon application of a voltage across these electrodes 47, 48, the comb-type electrodes 47*a*, 48*a* on the upper surface 44*a* cause this upper surface to elongate while the comb-type electrodes 47*b*, 48*b* on the lower surface 44*b* cause the lower surface to contract, as shown in FIG. 10. As a result, the vibrating plate 44 is bent with its free end bowed toward the nozzle 42 to thereby pressure the ink present between the nozzle plate 41 and the vibrating plate 44 and eject the pressured ink in the form of ink droplets through the nozzle 42.

Figure 9A:
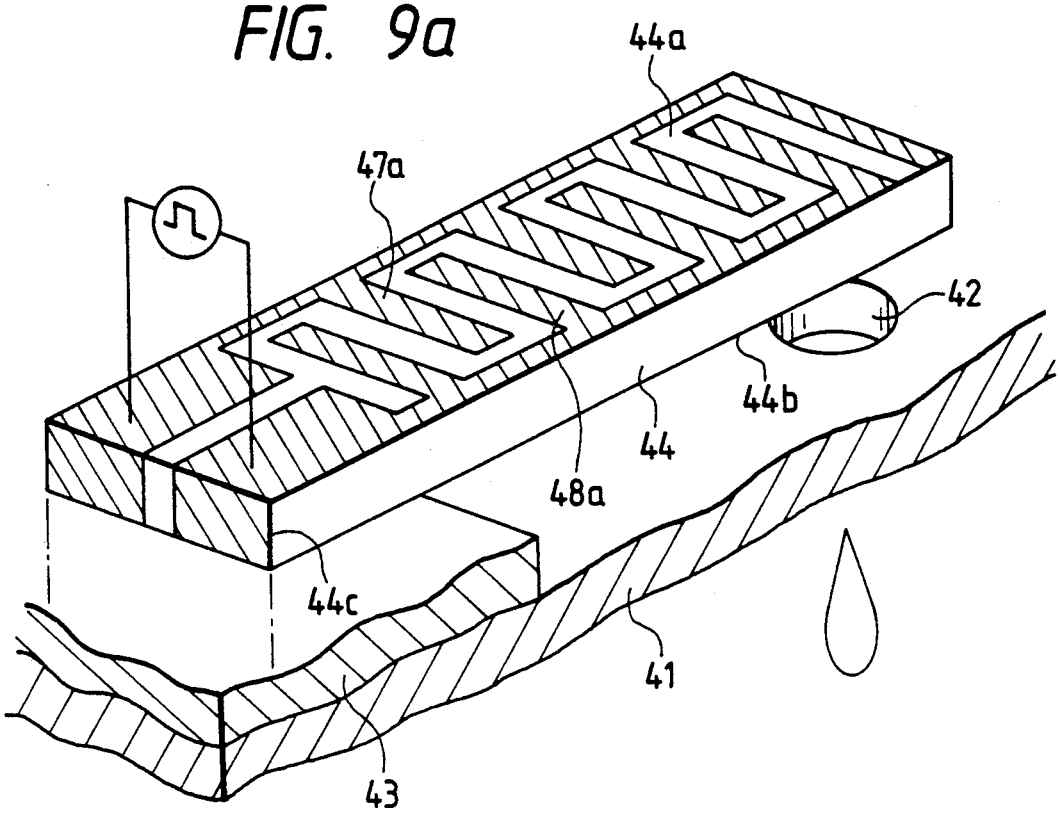
FIG. 9*a* is a view showing the main portion of a recording head according to a fourth embodiment of the present invention.
Figure 9B:
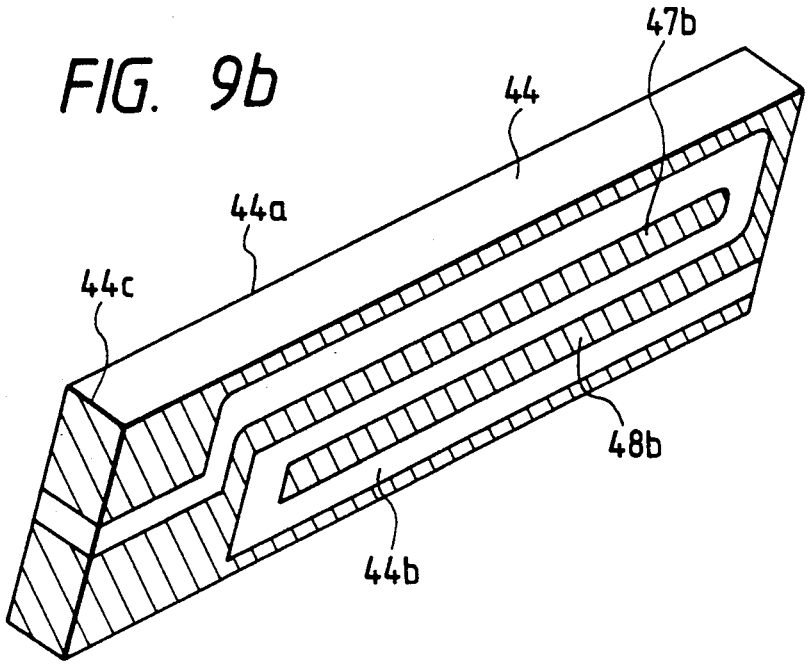
FIG. 9*b* is a view showing the back of a vibrating plate thereof.

FIGS. 9*a* and 9*b* show the comb-type electrodes 47, 48 formed on both upper and lower surfaces of each cantilever-type vibrating plate 44. However, the advantage similar to that described above may be provided by forming the comb-type electrodes 47, 48 only on the upper surface 44*a* opposite to the nozzle plate 41.

Figure 11:
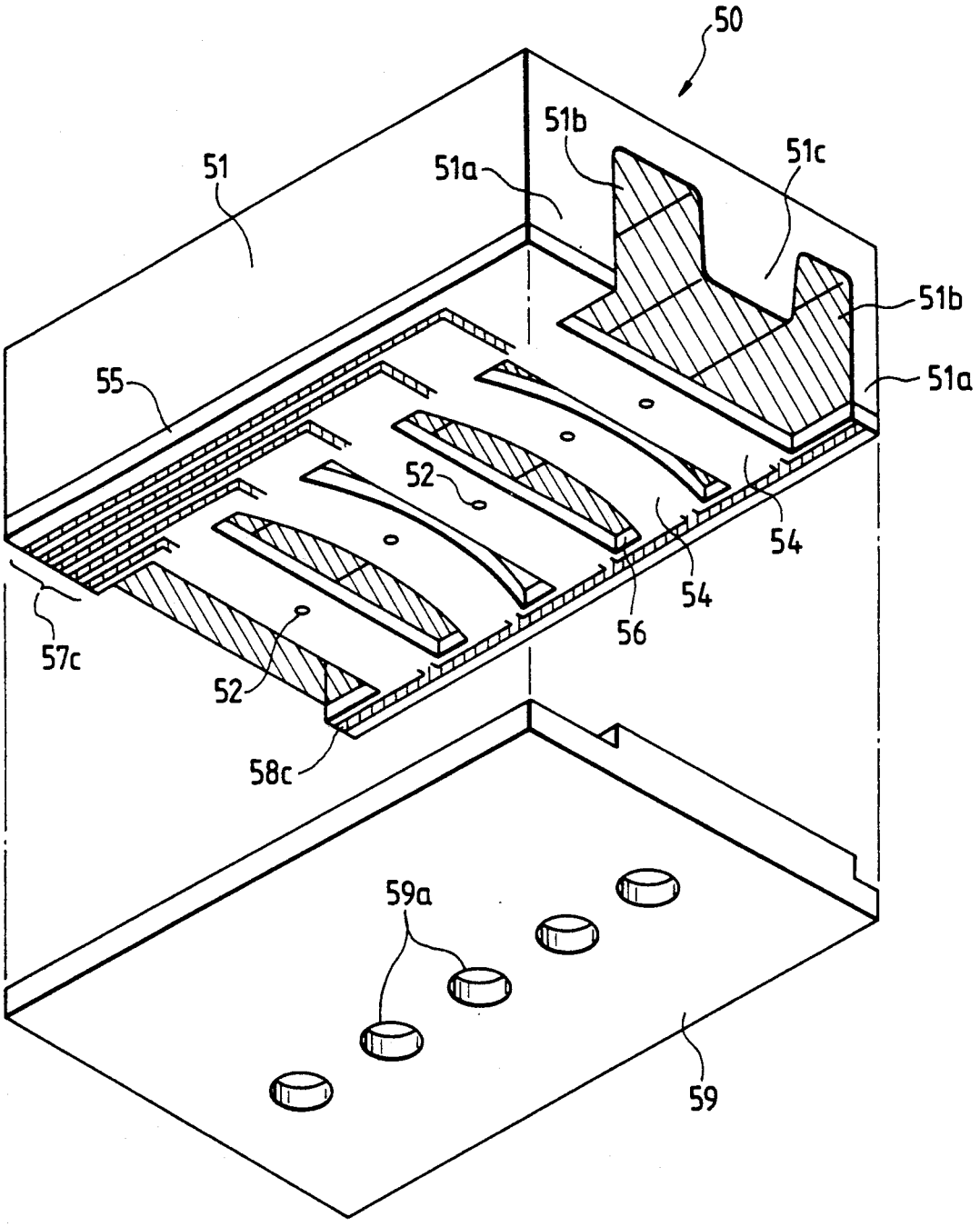
FIG. 11 is an exploded view showing a recording head according to a fifth embodiment of the present invention.

In contrast thereto, a fifth embodiment which is shown in FIG. 11 et. seq. has each nozzle formed on each vibrating plate itself to make the recording head simpler and thinner in design.

FIG. 11 shows the general construction of this fifth embodiment. The recording head 50 comprises a frame 51 and an ink pressuring member 55 fixed on the frame. The frame 51 is formed as a plate-like block that is E-shaped in cross section extending in the direction of arraying the nozzles 52. On both sides of the frame are projections 51*a* supporting the ink pressuring member 55. Between the ink containing grooves 51*b* in the middle region facing the nozzles 52 of the ink pressuring member 55, there is formed integrally with frame 51 a gap forming projection 51*c* that creates a gap of about 10 μm together with the vibrating plate 54.

The ink pressuring member 55 comprises a plurality of vibrating plates 54 separated from each other by slits 56. On each vibrating plate 54 is a nozzle 52 arranged at the middle in the longitudinal direction thereof.

Figure 12A:
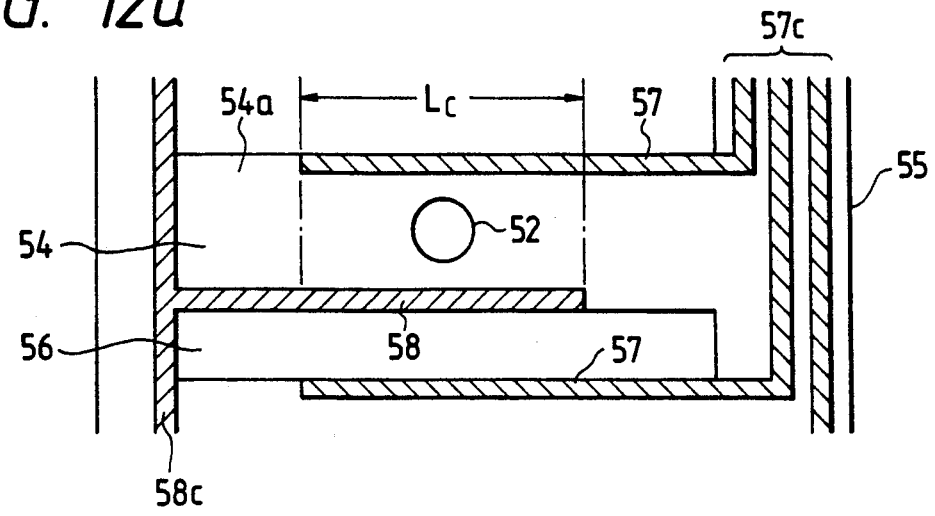
FIGS. 12*a* and 12*b* are views respectively showing electrode patterns to be formed on a vibrating plate thereof.

As shown in FIG. 12*a*, each vibrating plate 54 has a positive comb-type electrode 57 connected to an individual signal electrode 57*c* and a negative comb-type electrode 58 connected to the common electrode 58*c* on a surface 54*a* that does not come in contact with the ink. These comb-type electrodes 57, 58 are formed so that one or more comb tooth-like electrodes extending inward from both ends of the vibrating plate 54 can be meshed at the middle region Lc where a nozzle 52 is formed.

In FIG. 11, reference numeral 59 designates a seal body made of a soft resin material bonded on the upper surface of the ink pressuring member 55 to prevent leakage of the ink from the slits 56. This seal body 59 is provided with holes 59*a* not to hinder the ejection of ink from the nozzles 52.

Figure 13:
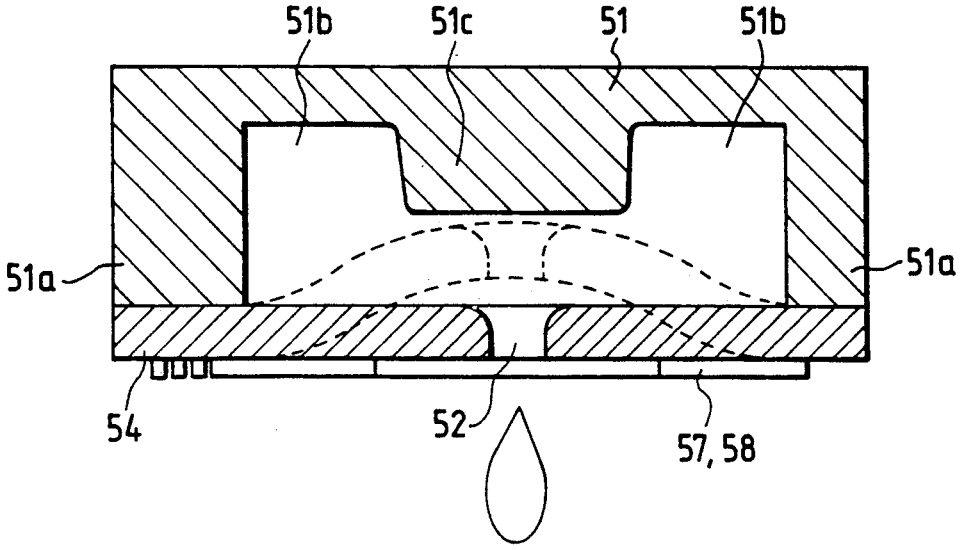
FIG. 13 is a view showing the operation of ejecting the ink by the vibrating plate.

In this embodiment, upon application of a voltage across the common electrode 58*c* and one or more selected signal electrodes 57*c*, the respective comb-type electrode 57, 58 on the vibrating plates 54 connected to these common and signal electrodes cause these selected vibrating plates 54 to be bent toward the gap forming projection 51*c* as shown in FIG. 13 thereby to increase the pressure on the ink on the periphery of the gap forming projection 51*c* and eject the pressured ink toward a recording sheet from the nozzles of these selected vibrating plates 54.

Figure 12B:
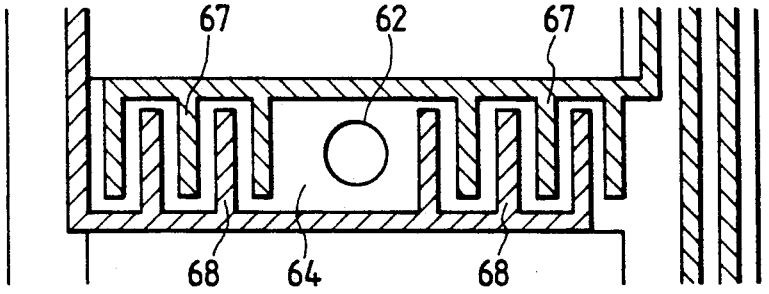

FIG. 12*b* shows another embodiment of the electrode pattern to be formed on each vibrating plate.

In this embodiment, a positive comb-type electrode 67 and a negative, comb-like electrode 68 are formed so as to face each other on both ends except for the middle region Lc of each vibrating plate 64 where a nozzle 62 is formed.

It is noted that the fifth embodiment shown in FIG. 11 is an example in which each vibrating plate 54 having the nozzle 52 is separated by the slits 56 so as to allow the vibrating plates to operate independently of each other.

Figure 14A:
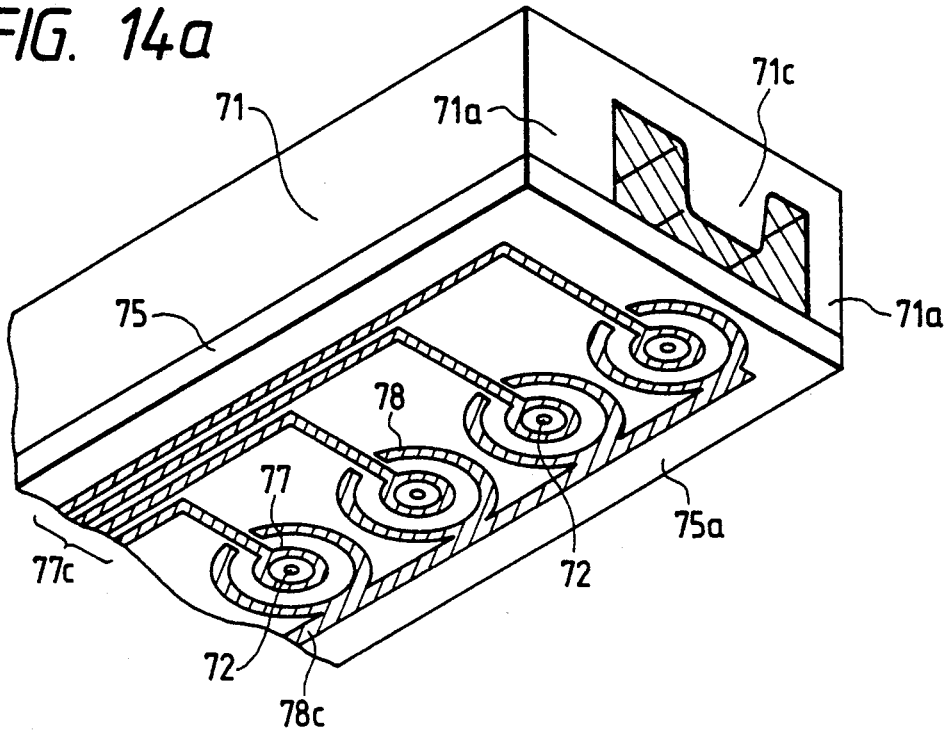
FIG. 14*a* and 14*b* are views respectively showing a recording head according to a sixth embodiment of the present invention and its operation of ejecting the ink.
Figure 14B:
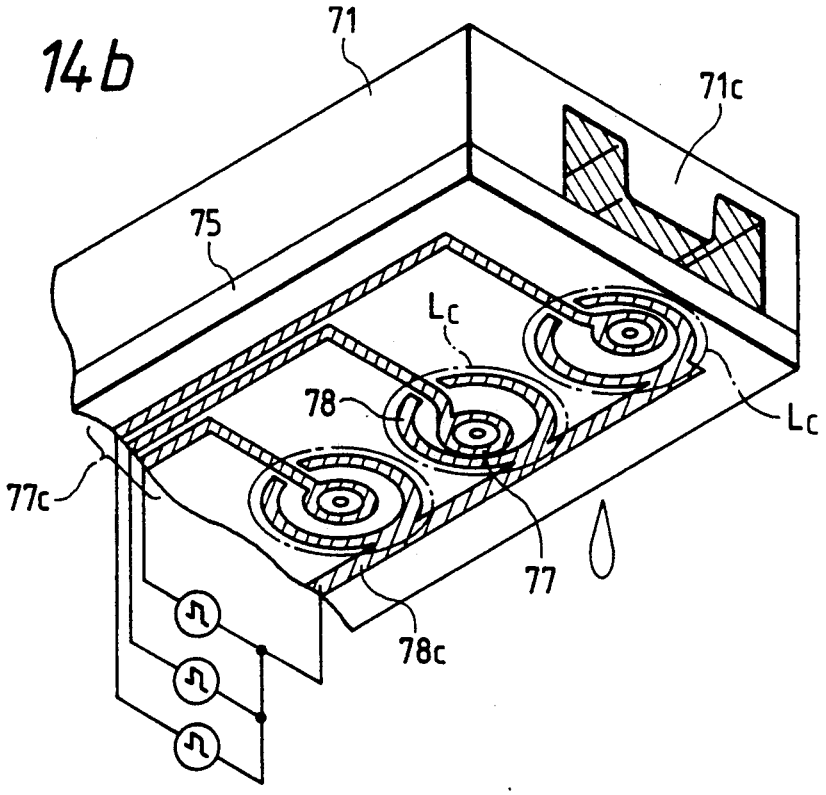

FIG. 14 shows a sixth embodiment so constructed that only selected nozzle forming portions can be deformed using a single ink pressuring member.

An ink pressuring member 75 fixed on supporting projected groove portions 71*a* of a frame 71 is made up of a plate body formed of a single piezoelectric material. On ink pressuring member 75 are a plurality of nozzles 72 arrayed in a direction along a gap forming projected groove portion 71*c* located at the middle of the frame 71. On an upper surface 75*a* that does not come in contact with the ink pressuring member 53 are a positive annular comb-type electrode 77 connected to an individual signal electrode 77*c* and a negative electrode 78*c* formed concentrically with each nozzle 72 so as to surround the nozzle 72.

Upon application of a voltage across the selected one or more signal electrodes 77*c* and the common electrode 78*c*, both annular comb-type electrodes 77, 78 cause a middle region Lc surrounding the corresponding nozzles 72 to be bent toward the gap forming projected groove portion 71*c*, thereby pressuring the ink in that region and ejecting the pressured ink in the form of ink droplets through the corresponding nozzles 72.

What is claimed is:

1. An ink jet printer recording head comprising two confronting members with a small gap for admitting a portion of ink therebetween, a first member of said two confronting members being provided with an ink ejecting nozzle and a second member of said two confronting members being made of a piezoelectric material to serve as an ink pressuring member, wherein at least one surface of said ink pressuring member is provided with a pair of positively and negatively polarized electrodes arranged in a longitudinal direction on a first portion of said ink pressuring member and in a transverse direction on a second portion of said ink pressuring member, such that a voltage applied across both of said electrodes deforms said ink pressuring member toward said nozzle thereby ejecting ink droplets through said nozzle.

2. An ink jet printer recording head according to claim 1, wherein only one surface of said ink pressuring member is provided with a pair of positively and negatively polarized comb-type electrodes.

3. An ink jet printer recording head according to claim 1, wherein both an upper and a lower surface of said ink pressuring member are provided with a pair of positively and negatively polarized comb-type electrodes.

4. An ink jet printer recording head according to claim 1, wherein one portion on a surface of said ink pressuring member corresponding to a position where a nozzle is arranged is provided with a pair of positively and negatively polarized comb-type electrodes having a first orientation, and other portions of said surface of said ink pressuring member are provided with a pair of positively and negatively polarized comb-type electrodes having a second orientation.

5. An ink jet printer recording head according to claim 2, wherein one portion on a surface of said ink pressuring member corresponding to a position where a nozzle is arranged is provided with a pair of positively and negatively polarized comb-type electrodes having a first orientation, and other portions of said surface of said ink pressuring member are provided with a pair of positively and negatively polarized comb-type electrodes having a second orientation.

6. An ink jet printer recording head according to claim 3, wherein one portion on a surface of said ink pressuring member corresponding to a position where a nozzle is arranged is provided with a pair of positively and negatively polarized comb-type electrodes having a first orientation, and other portions of said surface of said ink pressuring member are provided with a pair of positively and negatively polarized comb-type electrodes having a second orientation.

7. An ink jet printer recording head according to claim 1, wherein said ink pressuring member is of a cantilever-type.

8. An ink jet printer recording head according to claim 2, wherein said ink-pressuring member is of a cantilever-type.

9. An ink jet printer recording head according to claim 3, wherein said ink pressuring member is of a cantilever-type.

10. An ink jet printer recording head according to claim 4, wherein said ink pressuring member is of a cantilever-type.

11. An ink jet printer recording head according to claim 5, wherein said ink pressuring member is of a cantilever-type.

12. An ink jet printer recording head according to claim 6, wherein said ink pressuring member is of a cantilever-type.

13. An ink jet printer recording head comprising two confronting members with a small gap for admitting a portion of ink therebetween, a first member of said two confronting members being made of a piezoelectric material to form an ink pressuring member, wherein said first member is provided with an ink ejecting nozzle and a surface of said first member is provided with a pair of positively and negatively polarized comb-type electrodes.

14. An ink jet printer recording head according to claim 13, wherein said surface of said ink pressuring member is provided with a pair of positively and negatively polarized annular comb-type electrodes so as to surround said nozzle.

15. An ink jet printer recording head according to claim 13, wherein said ink pressuring member is provided with a plurality of slits to form a plurality of compartments, each consisting of a strip having a nozzle thereon, and wherein a surface of each strip is provided with a pair of positively and negatively polarized comb-type electrodes.

16. An ink jet printer recording head according to claim 13, 14 or 15, further comprising a gap forming projection which is provided opposite said ink ejection nozzle.

* * * * *